US009697689B2

(12) United States Patent
Chim et al.

(10) Patent No.: US 9,697,689 B2
(45) Date of Patent: Jul. 4, 2017

(54) GAMING MACHINE

(71) Applicant: Aristocrat Technologies Australia Pty Limited, North Ryde, NSW (AU)

(72) Inventors: Chi We Chim, Castle Hill (AU); William George Cormack, Lane Cove (AU)

(73) Assignee: Aristocrat Technologies Australia Pty Limited (AU)

( * ) Notice: Subject to any disclaimer, the term of this patent is extended or adjusted under 35 U.S.C. 154(b) by 86 days.

(21) Appl. No.: 14/064,551

(22) Filed: Oct. 28, 2013

(65) Prior Publication Data

US 2014/0051504 A1 Feb. 20, 2014

Related U.S. Application Data

(60) Continuation of application No. 12/690,668, filed on Jan. 20, 2010, now Pat. No. 8,585,491, which is a (Continued)

(30) Foreign Application Priority Data

Feb. 9, 2004 (AU) ..... 2004900644

(51) Int. Cl.
*G07F 17/32* (2006.01)

(52) U.S. Cl.
CPC ..... *G07F 17/3258* (2013.01); *G07F 17/32* (2013.01); *G07F 17/3267* (2013.01)

(58) Field of Classification Search
CPC ..... G07F 17/32; G07F 17/3258; A63F 2003/00167; A63F 2003/0017
See application file for complete search history.

(56) References Cited

U.S. PATENT DOCUMENTS 5,885,158 A 3/1999 Torango et al.
6,017,032 A 1/2000 Grippo et al.
(Continued)

FOREIGN PATENT DOCUMENTS

AU 199943453 12/1999
AU 200118314 8/2001
(Continued)

OTHER PUBLICATIONS

International Search Report from PCT/AU2005/000164, dated Apr. 20, 2005.

*Primary Examiner* — Damon Pierce
(74) *Attorney, Agent, or Firm* — McAndrews, Held & Malloy, Ltd.

(57) ABSTRACT

There is disclosed a gaming machine having a plurality of jackpot prizes associated with it, a player's eligibility to win one of the plurality of jackpot prizes being dependent upon an amount wagered. In a one aspect there is provided a gaming machine having a game control means arranged to play a game, a bet selecting arrangement for selecting one of a number of predetermined amounts to wager on the outcome of the game, each of said predetermined amounts to wager having at least one dedicated jackpot prize associated with it, a first display means configured to display the outcome of said game, wherein in the event that a predetermined winning event occurs said game includes the award of at least one dedicated jackpot prize associated with a respective selected predetermined amount wagered on the game.

19 Claims, 5 Drawing Sheets

Related U.S. Application Data division of application No. 10/589,309, filed as application No. PCT/AU2005/000164 on Feb. 9, 2005, now abandoned.

(56) References Cited

U.S. PATENT DOCUMENTS

| | | | | |
|---|---|---|---|---|
| 6,033,307 | A | 3/2000 | Vancura | |
| 6,241,608 | B1 | 6/2001 | Torango | |
| 6,319,127 | B1 | 11/2001 | Walker et al. | |
| 6,340,158 | B2 | 1/2002 | Pierce et al. | |
| 6,398,644 | B1 | 6/2002 | Perrie et al. | |
| 6,435,968 | B1 | 8/2002 | Torango | |
| 6,514,141 | B1 | 2/2003 | Kaminkow et al. | |
| 6,592,460 | B2 | 7/2003 | Torango | |
| 7,481,430 | B1 * | 1/2009 | Jackson | G07F 17/3244 273/138.1 |
| 2003/0211884 | A1 | 11/2003 | Gauselmann | |
| 2004/0009808 | A1 | 1/2004 | Gauselmann | |
| 2004/0023716 | A1 | 2/2004 | Gauselmann | |
| 2005/0037837 | A1 * | 2/2005 | Rowe | G06Q 30/0209 463/25 |

FOREIGN PATENT DOCUMENTS

| | | |
|---|---|---|
| AU | 2003203970 | 11/2003 |
| CA | 2334546 | 8/2001 |
| EP | 1341135 | 9/2003 |
| EP | 1380998 | 1/2004 |

* cited by examiner

GAMING MACHINE

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues.

When selecting a supplier of gaming machines, the operation of a venue will often pay close attention to the popularity of various games with their patrons. Therefore, gaming machine manufacturers are keen to devise games and/or game features which are popular with the players as a mechanism for improving sales, retaining customers and attracting new customers.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

Broadly, according to the invention, there is provided a gaming machine having a plurality of jackpot prizes associated with it, a player's eligibility to win one of the plurality of jackpot prizes being dependent upon an amount wagered.

In a first aspect there is provided a gaming machine having a game control means arranged to play a game, a bet selecting arrangement for selecting one of a number of predetermined amounts to wager on the outcome of the game, each of said predetermined amounts to wager having at least one dedicated jackpot prize associated with it, a first display means configured to display the outcome of said game, wherein in the event that a predetermined winning event occurs said game includes the award of at least one dedicated jackpot prize associated with a respective selected predetermined amount wagered on the game.

According to a second aspect of the invention, there is provided a gaming machine having a first display means and a game control means arranged to control images of symbols displayed on the first display means, the game control means being arranged to play a game wherein at least one random event is caused to be displayed on the first display means and, if a predefined winning event occurs, the machine awards a prize, the gaming machine further comprising a bet selecting arrangement for selecting one of a number of predetermined amounts to wager, and a plurality of jackpot prizes, each predetermined amount to wager having at least one jackpot prize associated with it.

The gaming machine can include a second display means configured to display a current value of the jackpot prizes. In one embodiment the second display means is mounted in a top box of the gaming machine.

The bet selecting arrangement can include, a keypad, a touch screen, an array of buttons, or the like.

The bet selection means is preferably configured to enable a selection of one of the predetermined amounts to wager prior to initiating game play.

The bet selection means can be further configured to enable a wager that is a multiple of a predetermined amount to wager. In the event that a player wagers a value that is a multiple of a predetermined amount to wager it is preferable that the player is eligible to win a jackpot prize associated with the predetermined amount to wager.

In certain embodiments of the gaming machine a plurality of jackpot prizes can be associated with at least one of the predetermined amounts to wager.

The jackpot prizes can be configured to accumulate from a predetermined minimum value and are incremented towards a predetermined maximum value. A jackpot prize associated with a particular predetermined amount to wager can be incremented by a portion of the amount wagered.

BRIEF DESCRIPTION OF THE DRAWINGS

Embodiments of the present invention will be described by way of example with reference to the accompanying diagrammatic drawings in which.

DETAILED DESCRIPTION OF THE DRAWINGS

Figure 1:
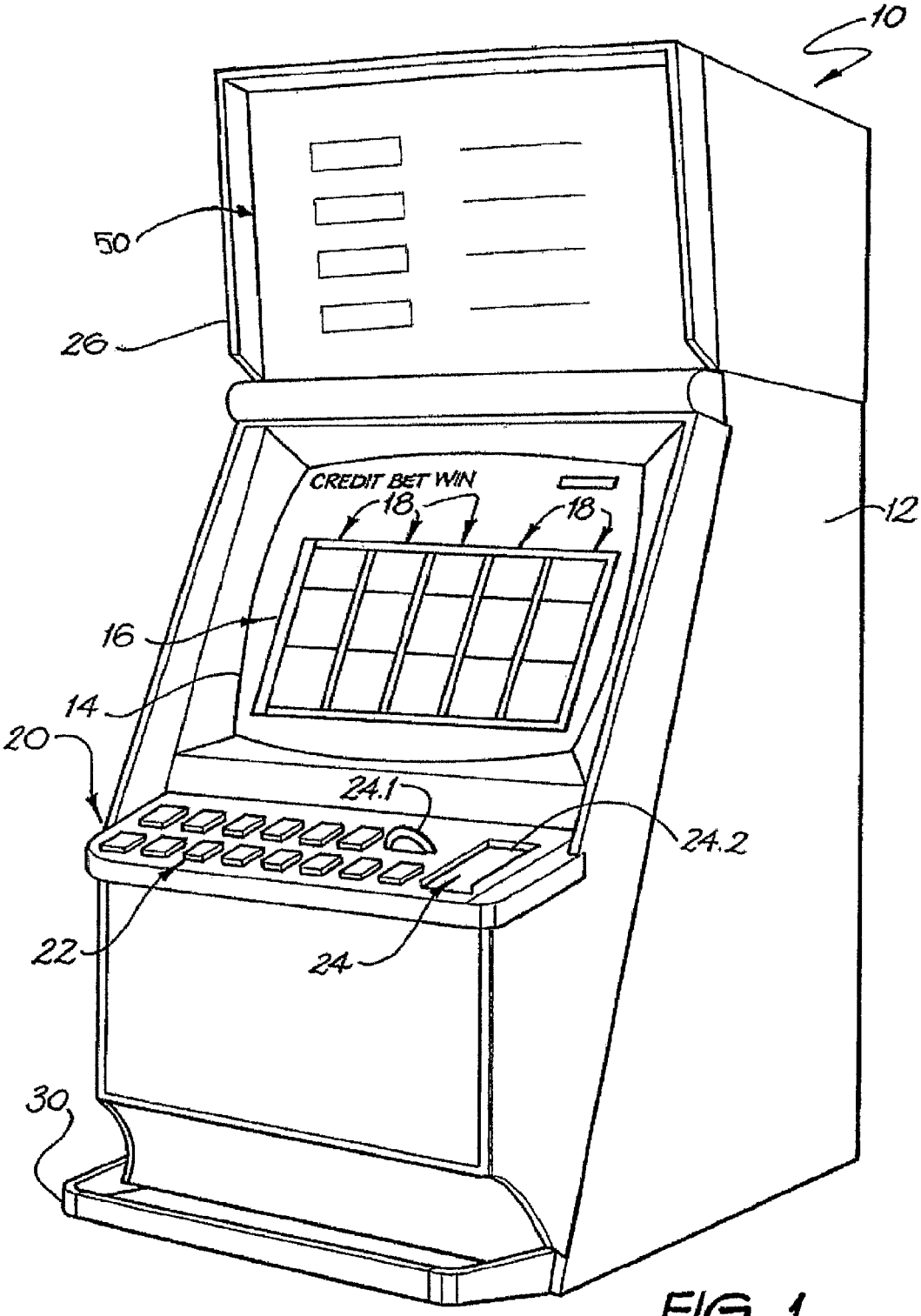
FIG. 1 shows a perspective view of a gaming machine, in accordance with an embodiment of the invention.

In FIG. 1, reference numeral 10 generally designates a gaming machine, in accordance with an embodiment of the invention. The machine 10 includes a console 12 having a display means in the form of a video display unit 14 on which a game 16 is displayed, in use. The video display unit 14 may be implemented as a cathode ray screen device, a liquid crystal display, a plasma screen, or the like. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 carrying a second display 50 as will be described in greater detail below. A coin tray 30 is mounted beneath the console 12 for cash payouts from the machine 10.

Figure 2:
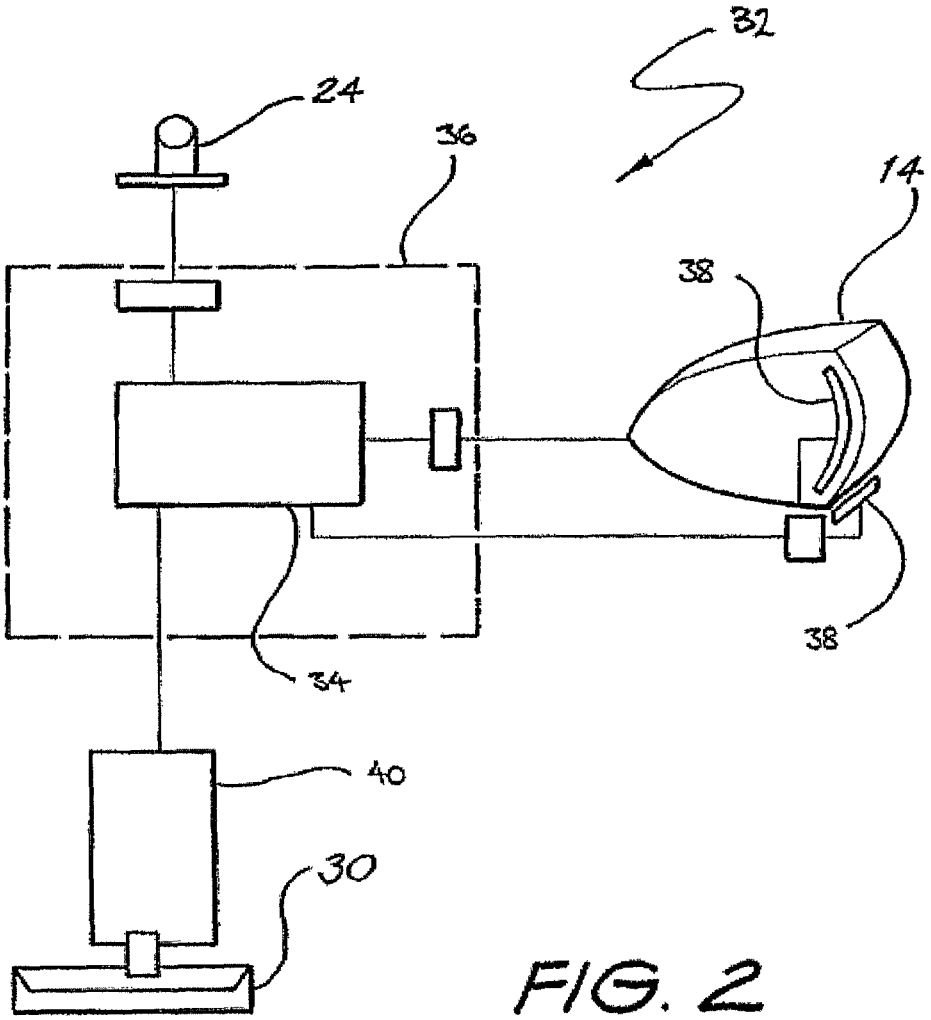
FIG. 2 shows a block diagram of a control circuit of the gaming machine of FIG. 1.

Referring to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from 15 sensors 38. The sensors 38 include sensors associated with the bank 22 of buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit 20 card reader (not shown) or any other type of validation device.

Finally, the controller 36 drives a payout mechanism 40 which, for example, may be a coin hopper for feeding coins to the coin tray 30 to make a payout to a player when the player wishes to redeem his or her credit.

Figure 3:
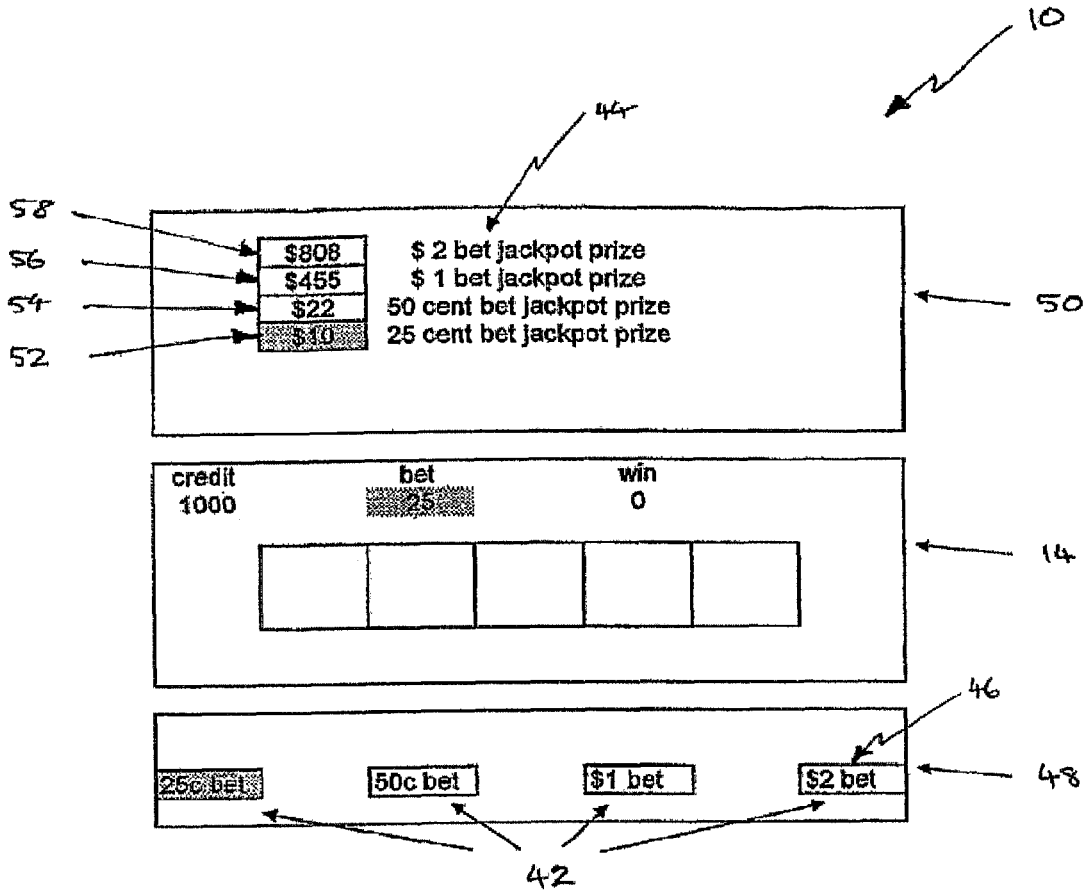
FIG. 3 shows a schematic drawing of a first embodiment of the gaming machine.

Referring now to FIG. 3 of the drawings, a first embodiment of the invention is illustrated. A number of progressive jackpot prizes 44 are associated with the gaming machine 10. Each jackpot prize 44 is associated with a unit bet value 46. In this example, there are four jackpot prizes 44 linked to the gaming machine 10, each jackpot prize 44 being associated with a different unit bet value 46.

The gaming machine 10 allows the player to choose the unit bet value 46 to be wagered. The bank 22 of buttons, of the gaming machine 10, includes a bet selecting arrangement 48. The bet selecting arrangement 48 has a button allocated to each unit bet value 46 that may be wagered by the player. In this example, the bet selecting arrangement 48 has four buttons 42. The gaming machine 10 further includes the secondary display 50 on which the current value of each of the jackpot prizes 44 is displayed. In the illustrative embodiment the secondary display 50 is mounted in the top box 26 of the gaming machine 10. Alternatively the secondary display may form a part of the information or image displayed on the video display unit 14. It will be appreciated that, in addition, the information regarding the values of the jackpot prizes 44 could be displayed on a remote display (not shown).

In use, the player selects the desired unit bet value 46 they wish to wager for the next game play using the bet selection arrangement 42. Having selected the unit bet value 46 the player is eligible to win the jackpot prize 44 associated with their chosen unit bet value 46. In the present example, the unit bet values 46 which the player may choose are twentyfive cents, fifty cents, one dollar, and two dollars. The respective jackpot prizes 44 are, therefore, a twentyfive cents jackpot 52, a fifty cents jackpot 54, a one dollar jackpot 56 and a two dollars jackpot 58.

To illustrate the operation of the game, a situation is taken in which the player has selected the twentyfive cents bet value 46 by operating the button 42. The player is therefore eligible to win the twentyfive cents jackpot 52. In this case, the current value of the twentylive cents jackpot 52 is ten dollars.

The player then presses a start button, located on the bank 22 of buttons, to initiate a game play. By initiating the game play, a portion of the bet value 46 wagered by the player contributes to the twentyfive cents jackpot 52. If the player had chosen to wager a bet value 46 of fifty cents, the player would contribute to, and be eligible to win, the fifty cents jackpot 54 currently at a value of twentytwo dollars. If the player had chosen to wager a bet value 46 of one dollar, the player would contribute to, and be eligible to win, the one dollar jackpot 56 currently at a value of four hundred and fiftyfive dollars. Finally, if the player had chosen to wager a bet value 46 of two dollars, the 30 player would contribute to, and be eligible to win, the two dollars jackpot 58 currently at a value of eight hundred and eight dollars.

Figure 4:
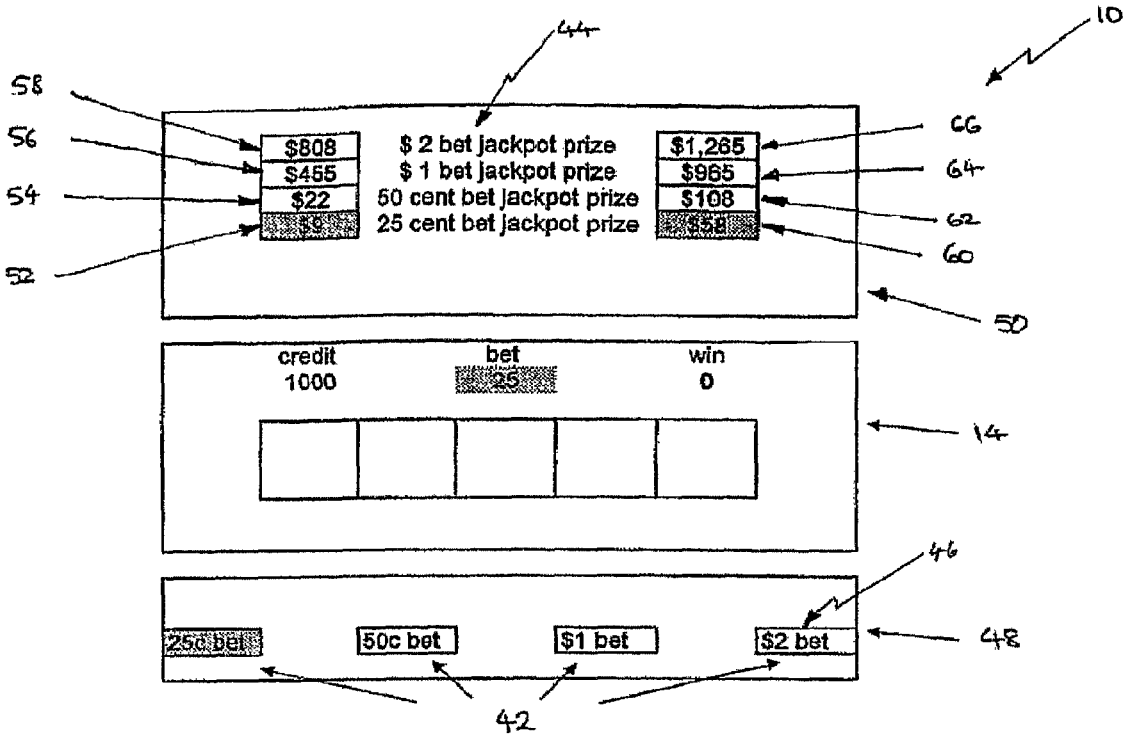
FIG. 4 shows a schematic drawing of a second embodiment of the gaming machine.

Referring now to FIG. 4 of the drawings, a second embodiment of the invention is illustrated.

In this embodiment, for each bet value 46 available to a player, there are two associated jackpot prizes 44. For a player selecting to wagered a bet value 46 of twentyfive cents the player would contribute to, and be eligible to win, both a first twentyfive cents jackpots 52 and a second twentyfive cents jackpot 60. The first twentyfive cents jackpot 52 is currently at a value of nine dollars and the second twentyfive cents jackpot 60 is currently at a value of fiftyeight dollars.

For a player selecting to wager a bet value 46 of fifty cents the player would contribute to, and be eligible to win, both a first fifty cents jackpot 54 and a second fifty cents jackpot 62. The first fifty cents jackpot 54 is currently at a value of twentytwo dollars and the second fifty cents jackpot 62 is currently at a value of one hundred and eight dollars.

For a player selecting to wager a bet value 46 of one dollar the player would contribute to, and be eligible to win, both a first one dollar jackpot 56 and a second one dollar jackpot 64. The first one dollar jackpot 56 is currently at a value of four hundred and fiftyfive dollars and the second one dollar jackpot 64 is currently at a value of nine hundred and sixtyfive dollars.

For a player selecting to wager a bet value 46 of two dollars the player would contribute to, and be eligible to win, both a first two dollars jackpot 58 and a second two dollars jackpot 66. The first two dollars jackpot 58 is currently at a value of eight hundred and eight dollars and the second two dollars jackpot 66 is currently at a value of one thousand two hundred and sixtyfive dollars.

It will be appreciated that, in general, in each case, the player's contribution to the jackpots 44 is divided between the respective jackpots corresponding to the amount wagered by the player. The portion of the wager allocated to the second, larger jackpot is greater than that allocated to the first, smaller jackpot. However, it will also be understood that, in certain circumstances, it may be desirable to increase the smaller jackpot at a greater rate than the larger jackpot. In such a case, a larger portion of the wager may be allocated to the smaller jackpot than the larger jackpot.

From this embodiment, it will also be appreciated that any number of jackpot prizes 44 could be associated with each bet value 46 and that any number of bet values could have one or more dedicated jackpot prizes associated therewith.

Figure 5:
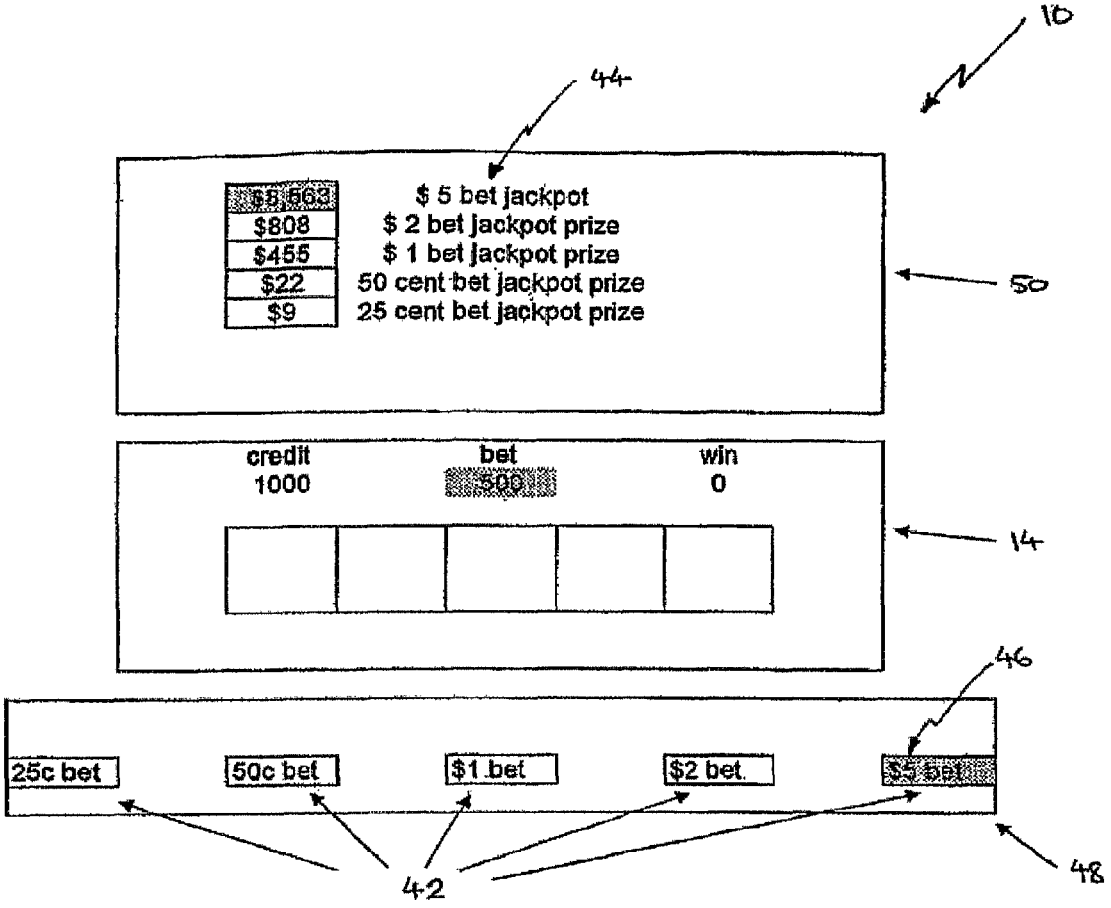
FIG. 5 shows a schematic drawing of a third embodiment of the gaming machine.

Referring now to FIG. 5 of the drawings, a third embodiment of the invention is illustrated.

In this embodiment, the gaming machine 10 has five bet values 46 from which the player may choose. Once again, for each bet value 46 there is an associated jackpot prize 44. Therefore, in this embodiment, there are five jackpot prizes 44. It will be appreciated that a gaming machine 10 in accordance with the present invention could have any number of bet values 46, with each bet value 46 having an associated jackpot prize 44. It is an advantage of an embodiment of the invention that a plurality of gaming machines may be linked to the jackpot prizes. The linked gaming machines may be of the same type or a combination of different types of machines. Thus, embodiments of the present invention may be applied to a group of spinning reel type games, card games or keno games or a combination of these. Also, by providing a jackpot prize associated with the bet value wagered, the applicant believes, the enjoyment and interest of a player will be enhanced. Still further a player can be eligible to win one or more jackpot prizes without necessarily having to place a maximum wager. Thus, players can still benefit from jackpot prizes even if making relatively small wagers.

It will be appreciated by persons skilled in the all that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine, comprising:

a credit input mechanism configured to receive a physical item associated with a monetary value and establish a credit balance, the credit balance being increasable and decreasable based at least on wagering activity;

one or more display units configured to display an outcome of a game of chance, a plurality of predefined wager amounts, and a plurality of current jackpot values for a plurality of jackpots, wherein each predefined wager amount has a different jackpot from the plurality of jackpots that is solely associated with the respective predefined wager amount;

a user interface that permits a player to wager one of the predefined wager amounts on the outcome of the game of chance;

a game controller configured to:

facilitate play of the game of chance;

identify which of the plurality of jackpots are solely associated with the placed predefined wager amount;

contribute the predefined wager amount solely to the identified jackpots and to play of the game of chance such that a first portion of the placed predefined wager amount is contributed to the identified jackpots and a second portion of the placed predefined wager amount is contributed to play of the game of chance;

display a random event on the one or more display units as the outcome of the game of chance; and award a prize based on the outcome of the game of chance and predetermined winning events associated with the identified jackpots; and a payout mechanism configured to payout the awarded prize.

2. The gaming machine of claim 1, wherein:

the user interface comprises a plurality of buttons that include a separate button for each predefined wager amount of the predefined wager amounts; and the plurality of buttons permit the player to select one of the predefined wager amounts to place on the outcome of the game of chance.

3. The gaming machine of claim 1, wherein the game controller is configure to award the different jackpot associated with the placed predefined wager amount in response to the outcome of the game of chance corresponding to a winning jackpot event.

4. The gaming machine of claim 1, wherein:

the one or more display units are further configured to display, for each predefined wager amount, a current jackpot value for a second different jackpot from the plurality of jackpots that is solely associated with the respective predefined wager amount; and the game controller is further configured to contribute to the second different jackpot associated with the placed predefined wager amount in response to contributing to the identified jackpots for the placed predefined wager amount.

5. The gaming machine of claim 4, wherein the game controller is further configured to unequally contribute to the first portion to the identified jackpots for the placed predefined wager amount resulting in the current jackpot amounts of the identified jackpots being incremented at different rates.

6. The gaming machine of claim 4, wherein the game controller is configured to award the second different jackpot associated with the placed predefined wager amount based on the outcome of the game of chance corresponding to a predetermined winning jackpot event for the second different jackpot.

7. The gaming machine of claim 1, wherein the one or more displays are further configured to display the random event via a plurality of spinning reels.

8. A method of gaming with a gaming machine having a credit input mechanism, a user interface, a display, a game controller, and a payout mechanism configured to cause a payout associated with the credit balance, the method comprising:

receiving, with the credit input mechanism, a physical item associated with a monetary value;

establishing, based on the received physical item, a credit balance that is increasable and decreasable based on wagering activity;

displaying, via the display of the gaming machine, a plurality of predefined wager amounts and a plurality of current jackpot values for a plurality of jackpots, wherein each predefined wager amount has a different jackpot from the plurality of jackpots that is solely associated the respective predefined wager amount;

receiving, via the user interface of the gaming machine, a user selection that identifies one of the predefined wager amounts as a predefined wager amount placed on an outcome of a game of chance;

identifying, with the game controller of the gaming machine, which of the plurality of jackpots are solely associated with the placed predefined wager amount;

contributing, from the established credit balance with the game controller of the gaming machine, the placed predefined wager amount solely to the identified jackpots and to play of the game of chance such that a first portion of the placed predefined wager amount is contributed to the identified jackpots and a second portion of the placed predefined wager amount is contributed to play of the game of chance;

displaying, via the display of the gaming machine, a random event as the outcome of the game of chance;

awarding, with the game controller of the gaming machine, a prize based on the outcome of the game of chance and predetermined winning events associated with the identified jackpots; and paying out the awarded prize via the payout mechanism of the gaming machine.

9. The method of claim 8, wherein said receiving comprises receiving the user selection via a plurality of buttons of the gaming machine that include a separate button for each predefined wager amount of the predefined wager amounts.

10. The method of claim 8, wherein said awarding comprises awarding the current jackpot value for the different jackpot from the plurality of jackpots corresponding to the placed predefined wager amount in response to the outcome of the game of chance corresponding to a predetermined winning jackpot event associated with the different jackpot.

11. The method of claim 8, further comprising:

displaying, with the gaming machine, for each predefined wager amount a corresponding second current jackpot value for a second different jackpot from the plurality of jackpots that is solely associated with the respective predefined wager amount; and contributing to the second current jackpot value corresponding to the placed predefined wager amount in response to contributing to the identified jackpots for the placed predefined wager amount.

12. The method of claim 8, further comprising displaying, with the gaming machine, for each predefined wager amount a corresponding second current jackpot value for a second different jackpot from the plurality of jackpots; and contributing the first portion unequally to the identified jackpots for the placed predefined wager amount resulting in the current jackpot values for the identified jackpots incremented at different rates.

13. The method of claim 11, further comprising awarding the second current jackpot value corresponding to the placed predefined wager amount based on the outcome of the game of chance corresponding to a predetermined winning jackpot event for the second different jackpot.

14. A non-transitory computer readable medium, comprising a program that in response to being executed by a game controller of a gaming machine having a credit input mechanism, a user interface, a display, a payout mechanism, results in a gaming machine:

establishing, based on physical item received by the credit input mechanism, a credit balance that is increasable and decreasable based on wagering activity;

displaying, via the display, a plurality of predefined wager amounts and a plurality of current jackpot values for a plurality of jackpots, wherein each predefined wager amount has a different jackpot from the plurality of jackpots that is solely associated with the respective predefined wager amount;

identifying one of the predefined wager amounts as a predefined wager amount placed on an outcome of a game of chance;

identifying which of the plurality of jackpots are solely associated with the placed predefined wager amount;

contributing, from the established credit balance, the placed predefined wager amount solely to the identified jackpots and to play of the game of chance such that a first portion of the placed predefined wager amount is contributed to the identified jackpots and a second portion of the placed predefined wager amount is contributed to play of the game of chance;

displaying, via the display, random event as the outcome of the game of chance;

awarding a prize based on the outcome of the game of chance and predetermined winning events associated with the identified jackpots; and paying out the awarded prize via the payout mechanism.

15. The non-transitory computer readable medium of claim 14, wherein the program, in response to being executed, further results in the gaming machine identifying the placed predefined wager amount based on a user selection received via a plurality of buttons of the gaming machine that include a separate button for each predefined wager amount of the predefined wager amounts.

16. The non-transitory computer readable medium of claim 14, wherein the program, in response to being executed, further results in the gaming machine awarding the current jackpot value corresponding to the placed predefined wager amount in response to the outcome of the game of chance corresponding to a predetermined winning jackpot event.

17. The non-transitory computer readable medium of claim 14, wherein the program, in response to being executed, further results in the gaming machine:

displaying for each predefined wager amount a corresponding second current jackpot value for a second different jackpot from the plurality of jackpots that is solely associated with the respective predefined wager amount; and contributing to the second current jackpot value corresponding to the placed predefined wager amount in response to contributing to the identified jackpots for the placed predefined wager amount.

18. The non-transitory computer readable medium of claim 17, wherein the program, in response to being executed, further results in the gaming machine awarding the second current jackpot value corresponding to the placed predefined wager amount based on the outcome of the game of chance corresponding to a predetermined winning jackpot event for the second different jackpot.

19. The non-transitory computer readable medium of claim 14, wherein the program, in response to being executed, further results in the gaming machine:

displaying for each predefined wager amount a corresponding second current jackpot value for a second different jackpot from the plurality of jackpots that is solely associated with the respective predefined wager amount; and contributing the first portion unequally to the identified jackpots for the placed predefined wager amount resulting in the current jackpot values for the identified jackpots being incremented at different rates.

* * * * *